US010045665B1

(12) United States Patent
Christmas

(10) Patent No.: US 10,045,665 B1
(45) Date of Patent: Aug. 14, 2018

(54) ADJUSTABLE BATHING BOOSTER SEAT SYSTEM

(71) Applicant: Victoria Christmas, Chicago, IL (US)

(72) Inventor: Victoria Christmas, Chicago, IL (US)

( * ) Notice: Subject to any disclaimer, the term of this patent is extended or adjusted under 35 U.S.C. 154(b) by 0 days.

(21) Appl. No.: 15/137,223

(22) Filed: Apr. 25, 2016

Related U.S. Application Data

(63) Continuation-in-part of application No. 13/847,980, filed on Mar. 20, 2013.

(60) Provisional application No. 61/638,756, filed on Apr. 26, 2012.

(51) Int. Cl.

| | |
|---|---|
| ***A47K 3/12*** | (2006.01) |
| ***A47K 3/28*** | (2006.01) |
| ***A61G 7/10*** | (2006.01) |
| *A47C 9/06* | (2006.01) |

(52) U.S. Cl.
CPC ..... *A47K 3/122* (2013.01); *A47K 3/282* (2013.01); *A61G 7/1003* (2013.01); *A47C 9/06* (2013.01)

(58) Field of Classification Search
CPC ..... A47K 3/12; A47K 3/282; A47K 3/127; A47K 3/074; A47K 3/064; A47K 3/07; A47K 3/164; A47K 3/122; A61G 7/1003; A61G 7/1005; A61G 7/1059; A61G 7/1076; A61G 7/1017; A61G 7/1069; A47C 9/06
USPC .... 4/560.1, 561.1, 562.1, 563.1, 572.1, 586, 4/589, 590
See application file for complete search history.

(56) References Cited

U.S. PATENT DOCUMENTS

| | | | | | |
|---|---|---|---|---|---|
| 1,199,002 | A * | 9/1916 | Freise | A47C 9/06 | 297/14 |
| 1,923,482 | A * | 8/1933 | Frankenstein | A47K 3/122 | 248/240.1 |
| 2,965,153 | A * | 12/1960 | Purcell, Sr. | A47K 3/122 | 108/33 |
| 3,254,615 | A * | 6/1966 | Gay | A47K 3/122 | 108/134 |
| 3,317,928 | A * | 5/1967 | Root | A61G 7/1003 | 312/235.2 |
| 3,633,901 | A * | 1/1972 | Lindquist | A61D 3/00 | 108/141 |
| 3,879,770 | A | 4/1975 | Grant | | |
| 4,087,127 | A * | 5/1978 | Lotta | A47C 9/06 | 108/81 |
| 4,554,691 | A * | 11/1985 | Daugherty | A61G 7/1017 | 318/16 |
| 4,733,418 | A * | 3/1988 | Luther | A61G 7/1003 | 4/562.1 |
| 5,477,574 | A * | 12/1995 | Skoe | A47K 3/12 | 135/65 |
| 6,351,860 | B1 | 3/2002 | Schaffer | | |
| 6,807,690 | B1 | 10/2004 | Satterfield | | |
| 7,562,402 | B1 * | 7/2009 | Calloway | A47C 17/132 | 4/572.1 |

(Continued)

*Primary Examiner* — Erin Deery
(74) *Attorney, Agent, or Firm* — Stephen T. Scherrer; Monique A. Morneault; Scherrer Patent & Trademark Law, P.C.

(57) ABSTRACT

An adjustable bathing booster seat system assists individuals with difficulty stepping into a conventional bathtub. It allows a user to be seated on a mechanically assisted seat member to maneuver them over the side of the bathtub and be lowered into the bathtub where they will be able to bathe themselves. When they finish bathing, they will then be lifted up and over the side of the bathtub where they will exit the adjustable bathing booster seat.

16 Claims, 9 Drawing Sheets

(56) References Cited

U.S. PATENT DOCUMENTS

2011/0131720 A1* 6/2011 Dean ..... A47K 3/12
4/564.1

* cited by examiner

ADJUSTABLE BATHING BOOSTER SEAT SYSTEM

CROSS-REFERENCE TO RELATED APPLICATION

The present applications are related to and claims priority from prior provisional application Ser. No. 61/638,756 filed Apr. 26, 2012, and application Ser. No. 13/847,980 filed Mar. 20, 2013, which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of bath accessories and more specifically relates to an adjustable bathing booster seat system to provide a safe means for the elderly and others who suffer from limited mobility to get in and out of a bathtub.

2. Description of the Related Art

With today's heightened awareness of health concerns and constantly improving medical care, Americans are living longer than ever before. As the baby boomer generation gets older, dramatic increases are expected in the elderly population. In fact, the U.S. Bureau of the Census estimates that people 65 and older will comprise 20.4 percent of the country's population by the year 2030, up from the current 13 percent. However, if the unprecedented increase in life expectancy has a downside, it is the exposure of risk to chronic age-related disorders. Such serious ailments as diabetes, Alzheimer's and Parkinson's diseases are but a few of the disabling disorders that keep many older persons from enjoying their longevity.

Additionally, the elderly also have to deal with physical infirmities brought on by the inevitability of aging. The scientific journal Age and Aging reports that some 50% of persons over age 65 have osteoarthritis and one-half of those are seriously disabled by the disease. However, challenges presented to those with limited mobility are not exclusive to the elderly. According to other statistics provided by the Census Bureau, nearly 8 percent of Americans between the ages of 15 and 64 suffer from some form of disability that hinders independent movement. Adding to these numbers are those with more temporary ailments, such as broken bones or postoperative conditions. All of these individuals, regardless of the health of the individual need to bathe at somewhat regular intervals.

As many with limited mobility can easily attest, attempting to complete day to day tasks without assistance can be daunting and frustrating. Arthritic patients often find it very difficult, if not impossible, to lower themselves to or rise from a seated position without experiencing extreme pain. Similarly, those recovering from hip or knee replacement surgery are unable to enjoy a refreshing and cleansing bath due to their inability to bend or kneel into the bathtub. Additionally, these mobility challenges contain a high degree of risk. Those without caregivers to lend a hand or without the proper equipment to support movement could seriously injure themselves in spills and falls, possibly fracturing bones or even breaking their hip. As a result, their condition could be effectively worsened. It is desirable that safe and convenient bathing conditions be made available to all individuals.

Various attempts have been made to solve the above-mentioned problems such as those found in U.S. Pat. No. 3,879,770 to Grant; U.S. Pat. No. 6,351,860 to Schaffer; and U.S. Pat. No. 6,807,690 to Satterfield. This prior art is representative of bath accessories. None of the above inventions and patents, taken either singly or in combination, is seen to describe the invention as claimed.

Ideally, an adjustable bathing booster seat system should provide a safe and easy way for the elderly and others who suffer from limited mobility to get in and out of a bathtub, and yet, would operate reliably and be manufactured at a modest expense. Thus, a need exists for a reliable adjustable bathing booster seat system to avoid the above-mentioned problems.

BRIEF SUMMARY OF THE INVENTION

In view of the foregoing disadvantages inherent in the known bath accessories art, the present invention provides a novel adjustable bathing booster seat system. The general purpose of the present invention, which will be described subsequently in greater detail, is to provide a safe and easy way for the elderly and others who suffer from limited mobility to get in to and out of a bathtub.

The adjustable bathing booster seat system will be appreciated by individuals with difficulty stepping into a conventional bathtub. It allows a user to be seated on a platform and use a hydraulic lift system to maneuver them over the side of the bathtub and be lowered into the bathtub where they will be able to bathe themselves. When they finish bathing, they will then be lifted up and over the side of the bathtub where they will exit the adjustable bathing booster seat.

An adjustable bathing booster seat system is disclosed, in a preferred embodiment, comprising in combination a booster seat assembly, a wall mount assembly, and a battery to provide power to operate the hydraulic lift. The booster seat assembly, located at the head of a bathtub, preferably comprises in combination a seat portion having a back rest, a seat platform having two arm rests and an opening, a leg support section (the length of the legs of the bather to fully support them) able to be lowered, raised, folded and unfolded about an axis in relation to the bathtub, and a release lever for a user to manipulate the booster seat assembly into a desired position.

The booster seat assembly is preferably fabricated of durable recycled plastic material such that it doesn't corrode with use and may be covered with a nonslip rubber surface (or the like) to protect the user from sliding about on the seat portion. The leg support section of the booster seat assembly is manipulable about a hinge to form an axis, thus the booster seat assembly comprises an upright-chair when desired or a lounge-chair when desired. The design lends to good stability of the user during operation.

The wall mount assembly of the adjustable bathing booster seat system comprises in combination a vertical mount member preferably comprising a vertical slot, a swivel arm coupler, a swivel arm (comprising a gusset), and a hydraulic lift (or other suitably equivalent lifting means) for moving the booster seat assembly into and out of a bathtub. The wall mount assembly is secured to a wall adjacent the head of the bathtub and preferably comprises carbon fiber/stainless steel hardware such that the wall mount assembly doesn't corrode with use and yet is relatively inexpensive to produce. The wall mount assembly is secured to the wall preferably using stainless steel hardware and is structurally mounted (and reinforced) to a wall in a manner to support the combined weight of booster seat assembly and the user up to a body weight of 400 lbs.

The swivel arm coupler of the wall mount assembly is able to move along a length of the vertical wall mount as moved by the hydraulic lift using a release lever as controlling means; the release lever preferably comprising a joystick (able to be used by user or another), to raise and lower the booster seat assembly in relation to the bathtub. Additionally, the swivel arm coupler is able to rotate in relation to the vertical mount member to position the booster seat assembly in relation to the bathtub. The adjustable bathing booster seat system is sized and shaped to fit inside a standard-sized bathtub. The bathtub receives water from a water faucet preferably located at the side of the bathtub, with the bathtub side being located opposite a location of the booster seat assembly when the booster seat assembly is outside of and perpendicularly orientated to the bathtub. This orientation provides that the operation of the booster seat assembly is not hindered by plumbing location.

When ready for use, the user is able to sit on the booster seat assembly, with the booster seat assembly initially being located outside of the bathtub when the leg support section is in a folded-down position. The user is then able to move the booster seat assembly from a perpendicular positioning relative to the bathtub (initial at rest position) to a parallel positioning above the bathtub by activating the release lever to raise and unfold the leg support section of the booster seat assembly by rotating the booster seat assembly via the hydraulic lift in combination with the release lever. The swivel arm is affixed to the swivel arm coupler on one end and connected to the seat platform on the other end. The swivel arm coupler rotates in relation to and adjacent to the vertical mount member. The hydraulic lift is powered by a battery such that when the user is sitting on the seat portion parallel to the bathtub the user is able to be lowered into a cavity of the bathtub ready for bathing in a semi-lying position with the booster seat assembly supporting the user before, during and after bathing.

A kit is included for the adjustable bathing booster seat system including a booster seat assembly, a wall mount assembly including a hydraulic lift, a battery providing a source of power, and a set of user instructions. A method of use for the adjustable bathing booster seat system is also disclosed herein.

The present invention holds significant improvements and serves as an adjustable bathing booster seat system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, adjustable bathing booster seat system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a bath accessory device and more particularly to a adjustable bathing booster seat system as used to improve the ability of elderly and other persons who suffer from limited mobility to get in and out of a bathtub.

Generally speaking, many people prefer taking a bath as a way of cleansing their body and often enjoy lounging in a hot bath to relax. However, many elderly people and others who may have a physical limitation that inhibits their ability to get into and out of a bathtub safely. The adjustable bathing booster seat system disclosed herein provides those persons with limited mobility due to age or other physical condition the ability to bath in a conventional bathtub in a safe manner without being concerned about tripping and falling while entering or exiting the bathtub.

Figure 1:
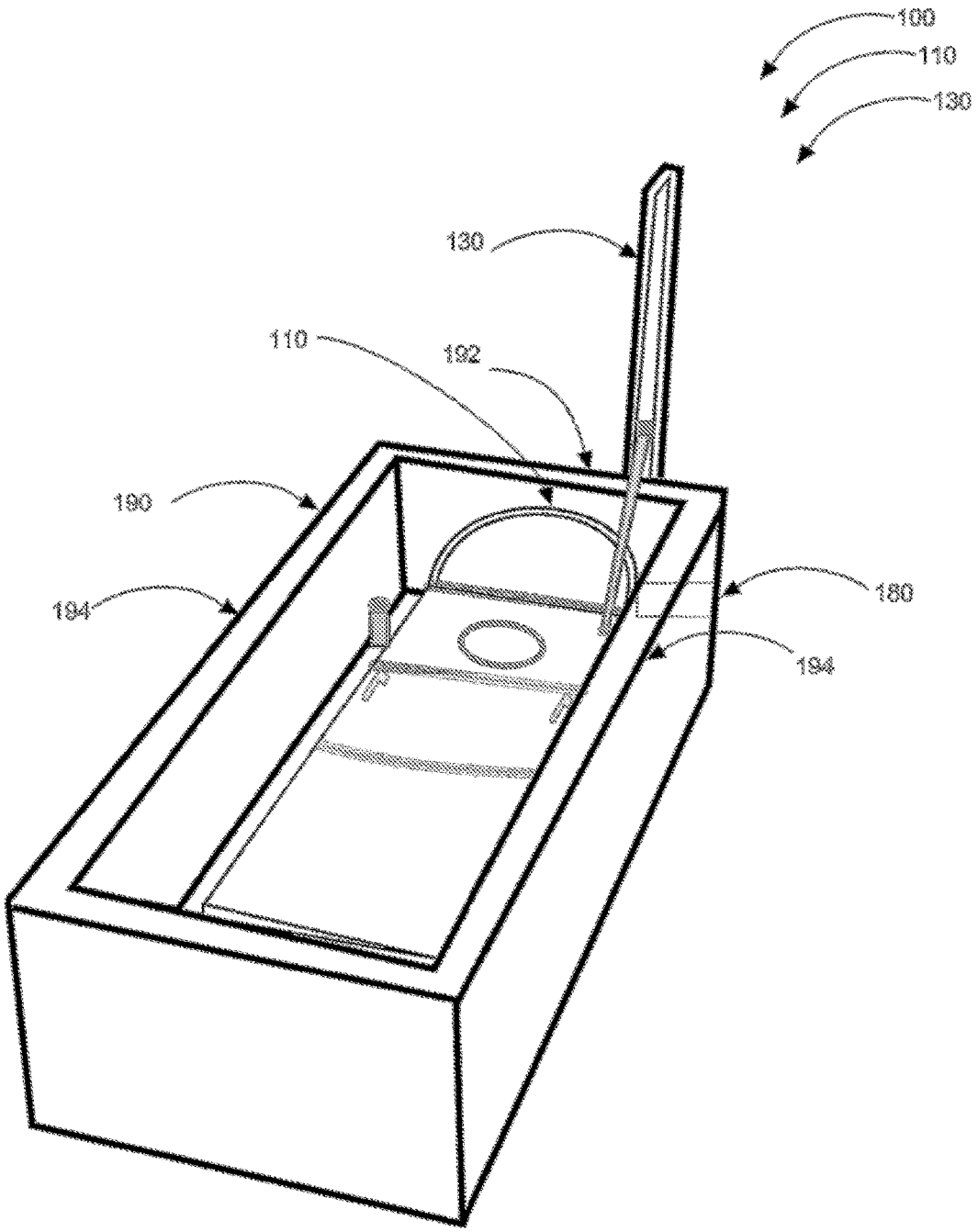
FIG. 1 shows a perspective view illustrating an adjustable bathing booster seat system lowered into a bathtub according to an embodiment of the present invention.

Referring to the drawings by numerals of reference there is shown in FIG. 1, a perspective view illustrating booster seat assembly 110 of adjustable bathing booster seat system 100 lowered into bathtub 190 according to an embodiment of the present invention.

Adjustable bathing booster seat system 100 preferably comprises booster seat assembly 110, wall mount assembly 130, and battery 180; battery 180 to provide power to operate hydraulic lift 133 of wall mount assembly 130. Booster seat assembly 110, is preferably located at head 192 of bathtub, and comprises in combination seat portion 115 having back rest 118, seat platform 120 having two arm rests 122 and opening 124. Leg support section 126 is able to be lowered, raised, folded and unfolded about axis 128 such that the present invention may be moved in relation to bathtub 190. Release lever 129 allows a user to manipulate booster seat assembly 110 into a desired position.

Figure 2:
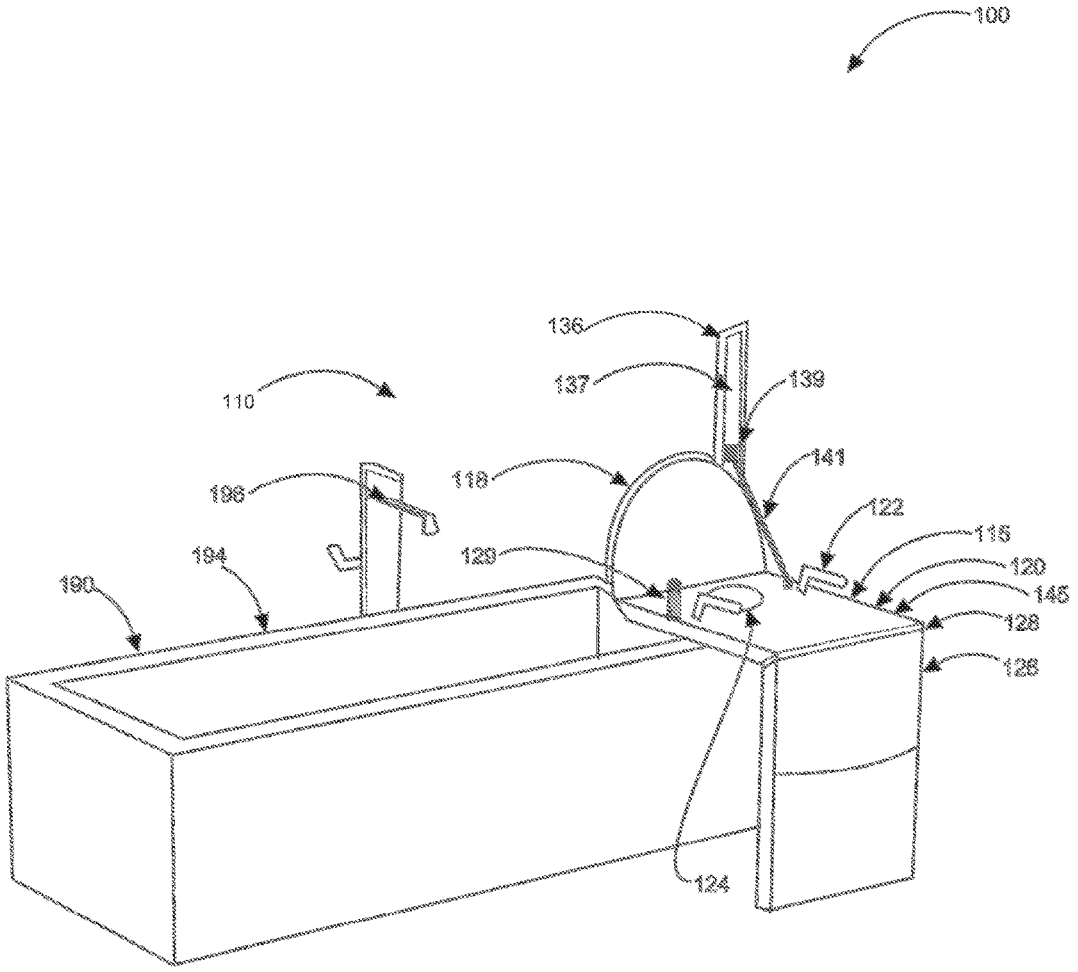
FIG. 2 is a perspective view illustrating an adjustable bathing booster seat system at the side of a bathtub (initial position) ready for movement into a bathtub according to an embodiment of the present invention of FIG. 1.

Referring now to FIG. 2, a perspective view illustrating booster seat assembly 110 of adjustable bathing booster seat system 100 at side 194 of bathtub 190 ready for movement into bathtub 190 according to an embodiment of the present invention of FIG. 1.

Booster seat assembly 110 is preferably fabricated of durable recycled plastic material such that it doesn't corrode with use and is covered with a nonslip rubber surface to protect the user from sliding about on seat portion 115. Leg support section 126 of booster seat assembly 110 is manipulable about a hinge (to form axis 128), thus booster seat assembly 110 comprises upright-chair 145 (FIG. 2) when desired or lounge-chair 146 (FIGS. 1 and 4) when desired.

Wall mount assembly 130 of adjustable bathing booster seat system 100 comprises in combination vertical mount member 136 comprising vertical slot 137, swivel arm coupler 139, swivel arm 141, comprising a gusset, and hydraulic lift 133 for moving booster seat assembly 110 into and out of bathtub 190. Wall mount assembly 130 is secured to a wall adjacent head 192 of bathtub 190 and preferably comprises carbon fiber/stainless steel hardware such that wall mount assembly 130 doesn't corrode with use. Other materials may be used. Wall mount assembly 130 may be secured to the wall using stainless steel hardware and is structurally mounted to a wall in a manner to support the combined weight of booster seat assembly 110 and the user up to a body weight of 400 lbs.

Figure 3:
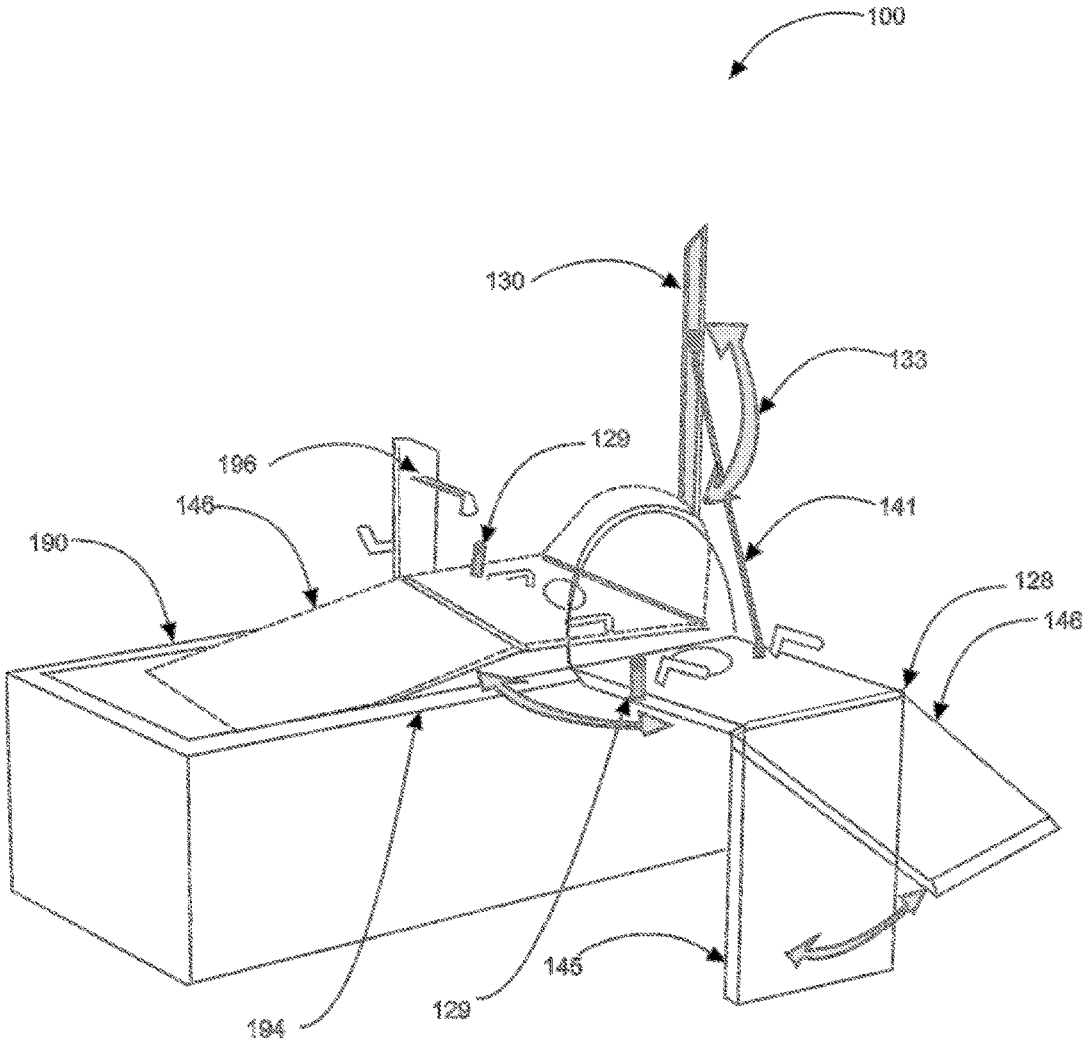
FIG. 3 is a perspective view illustrating a booster seat assembly of the adjustable bathing booster seat system being swiveled into position for lowering into a bathtub with dotted lines representing the booster seat assembly ready to be lowered into the bathtub according to an embodiment of the present invention of FIG. 1.

Referring now to FIG. 3, a perspective view illustrating booster seat assembly 110 of adjustable bathing booster seat system 100 being swiveled into position for lowering into bathtub 190 with dotted lines representing booster seat assembly 110 in position to be lowered into bathtub 190 according to an embodiment of the present invention of FIG. 1.

To use booster seat assembly 110 for bathing, the user must lift and rotate booster seat assembly 110 from outside of bathtub 190 to the inside of bathtub 190 by sitting on upright chair 145 configuration of booster seat assembly 110 and using release lever 129 to relocate booster seat assembly 110 to a position above bathtub 190. Swivel arm coupler 139 of wall mount assembly 130 is able to move along a length of vertical wall mount 136 as moved by hydraulic lift 133 using release lever 129. Release lever 129 may comprise a joystick, to raise and lower booster seat assembly 110 in relation to bathtub 190. Additionally, swivel arm coupler 139 is able to rotate in relation to vertical mount member 136 to position booster seat assembly 110 in relation to bathtub 190. Hydraulic lift 133 is powered by battery 180 such that when the user is sitting on seat portion 115 of booster seat assembly 110 parallel to bathtub 190 the user is able to be lowered into a cavity of bathtub 192 ready for bathing in a semi-lying position with booster seat assembly 110 in lounge chair 146 orientation supporting the user before, during and after bathing.

Figure 4:
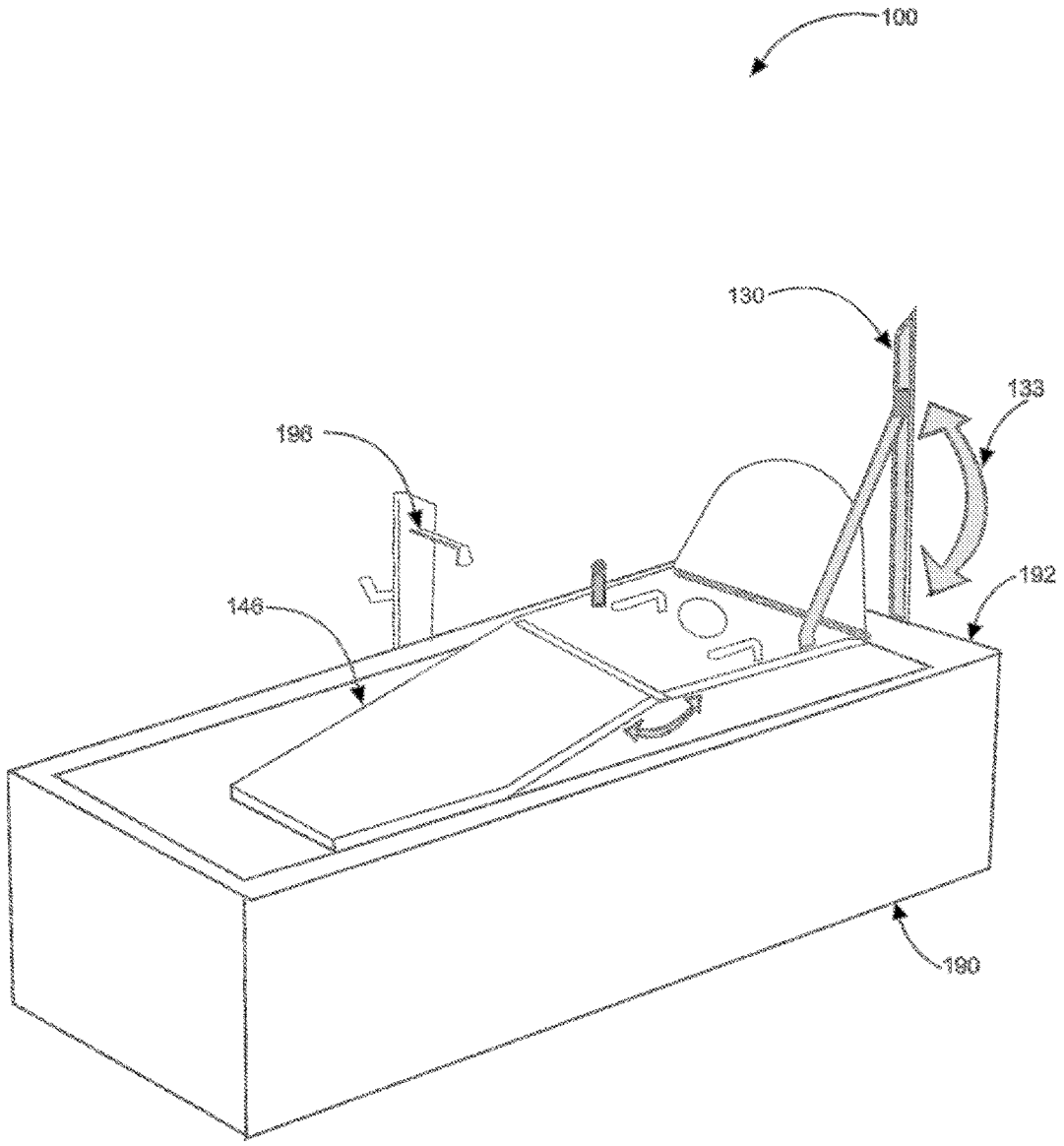
FIG. 4 is a perspective view illustrating a booster seat assembly of the adjustable bathing booster seat system ready to be lowered into a bathtub according to an embodiment of the present invention of FIG. 1.

Referring now to FIG. 4, a perspective view illustrating booster seat assembly 110 of adjustable bathing booster seat system 100 ready to be lowered into bathtub 190 according to an embodiment of the present invention of FIG. 1.

Bathtub 190 preferably receives water from water faucet 196 located at side 194 of bathtub 190, with bathtub 190 side 194 being located opposite a location of booster seat assembly 110 when booster seat assembly 110 is outside of and perpendicularly orientated to bathtub 190, as in FIG. 2. Adjustable bathing booster seat system 100 is sized and shaped to fit inside bathtub 190 of standard size, as shown in FIG. 1).

When ready for use, the user is able to sit on booster seat assembly 110, with booster seat assembly 110 initially being located outside of bathtub 190 when leg support section 126 is in a folded-down position (as in FIG. 2). The user is then able to move booster seat assembly 110 from a perpendicular positioning relative to bathtub 190 to a parallel positioning above bathtub 190 (shown in FIG. 3) by activating release lever 129 to raise and unfold leg support section 126 of booster seat assembly 110 by rotating booster seat assembly 110 via hydraulic lift 133 in combination with release lever 129. Swivel arm 141 is affixed to swivel arm coupler 139 on one end and connected to seat platform 120 on the opposite end. Swivel arm coupler 139 rotates in relation to and adjacent to vertical mount member 136.

Adjustable bathing booster seat system 100 may be sold as a kit comprising the following parts: at least one booster seat assembly 110 including at least two arm rests 122 and release lever 129, wall mount assembly 130 including hydraulic lift 133 and swivel arm 141 to couple booster seat assembly 110 and wall mount assembly 130, battery 180 for a source of power, and at least one set of user instructions. Adjustable bathing booster seat system 100 may be manufactured and provided for sale in various sizes and colors based on the size and color of bathtub 190 being used. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different lifting means and powering combinations, parts may be sold separately, etc., may be sufficient.

Figure 5:
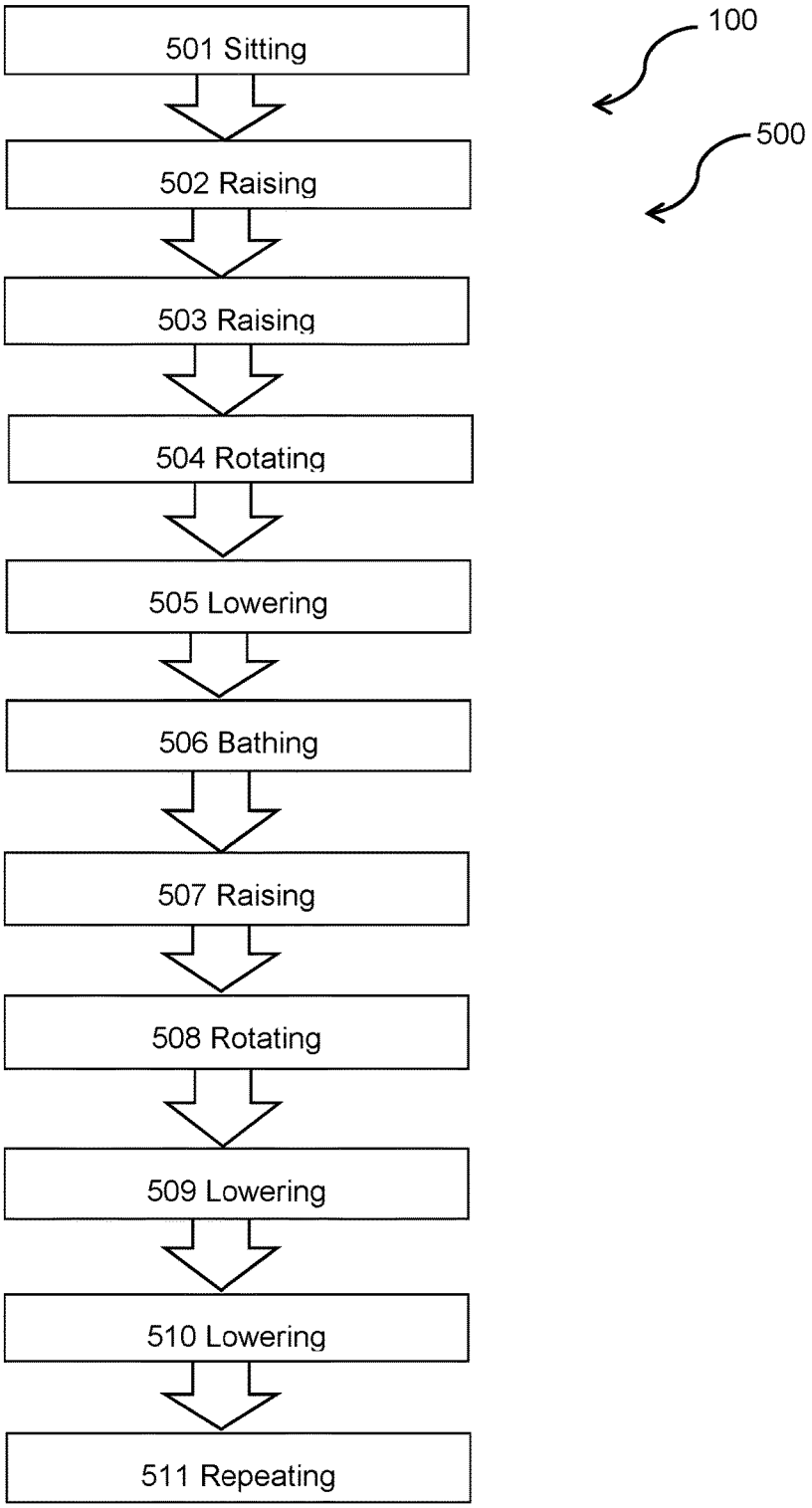
FIG. 5 is a flowchart illustrating a method of use of the adjustable bathing booster seat system according to an embodiment of the present invention of FIGS. 1-4.
Figure 6:
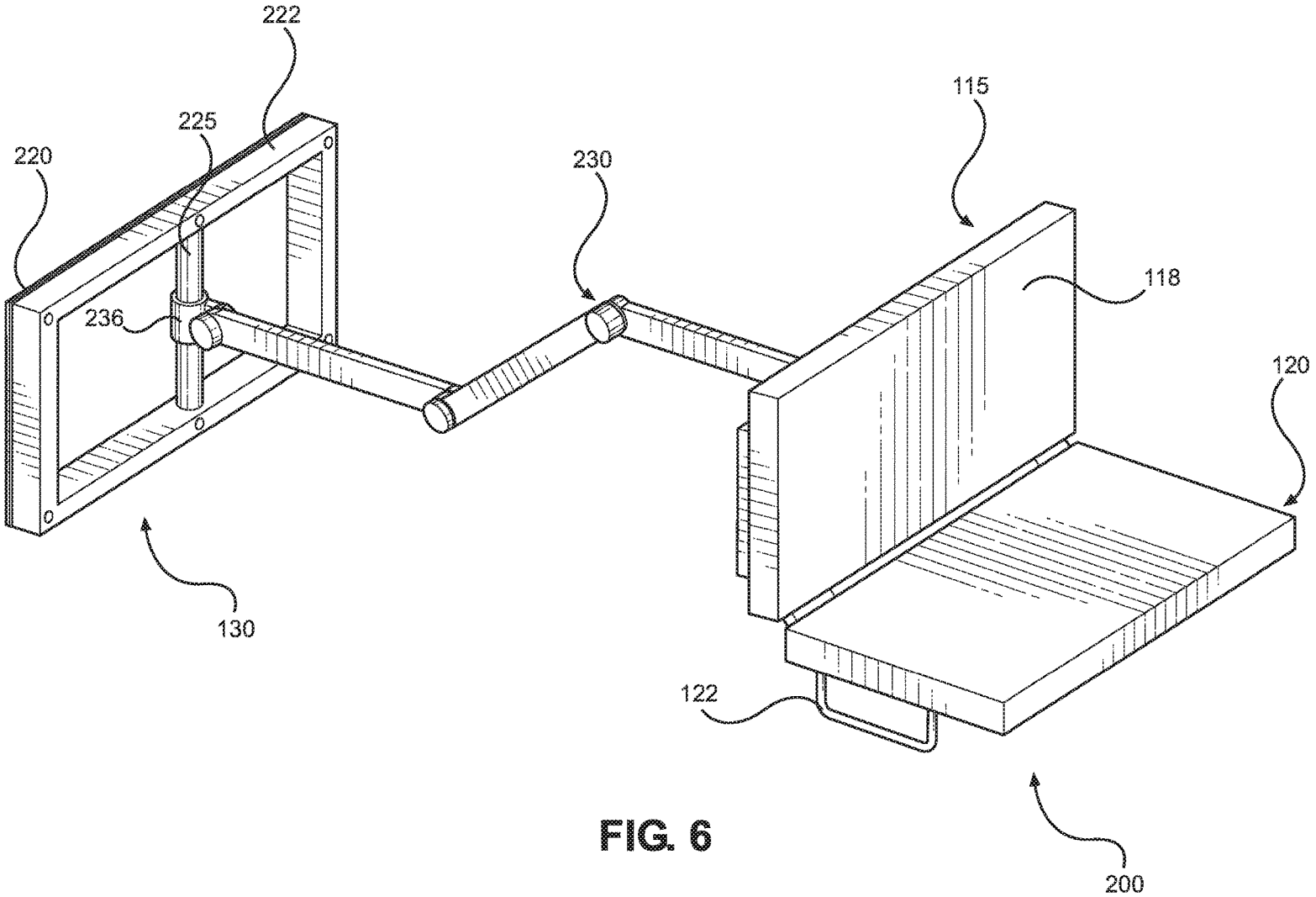
FIG. 6 shows a front side perspective view illustrating an alternate embodiment of the adjustable bathing booster seat system of the present invention.
Figure 7:
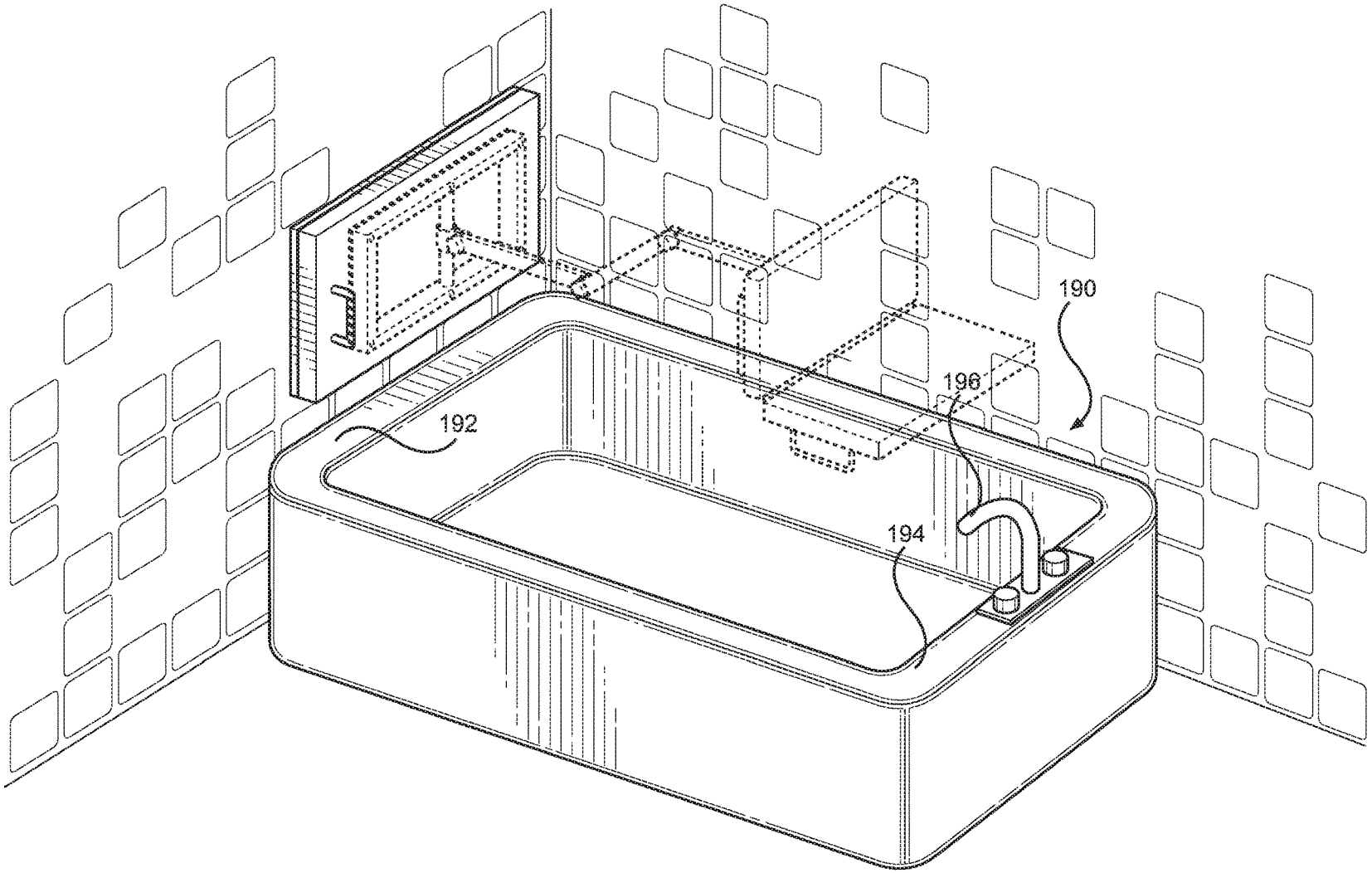
FIG. 7 shows a perspective view illustrating an adjustable bathing booster seat system of the alternate embodiment of the present invention of FIG. 6 installed within a wall and then (in dashed lines) extended outwardly over the bathtub.
Figure 8:
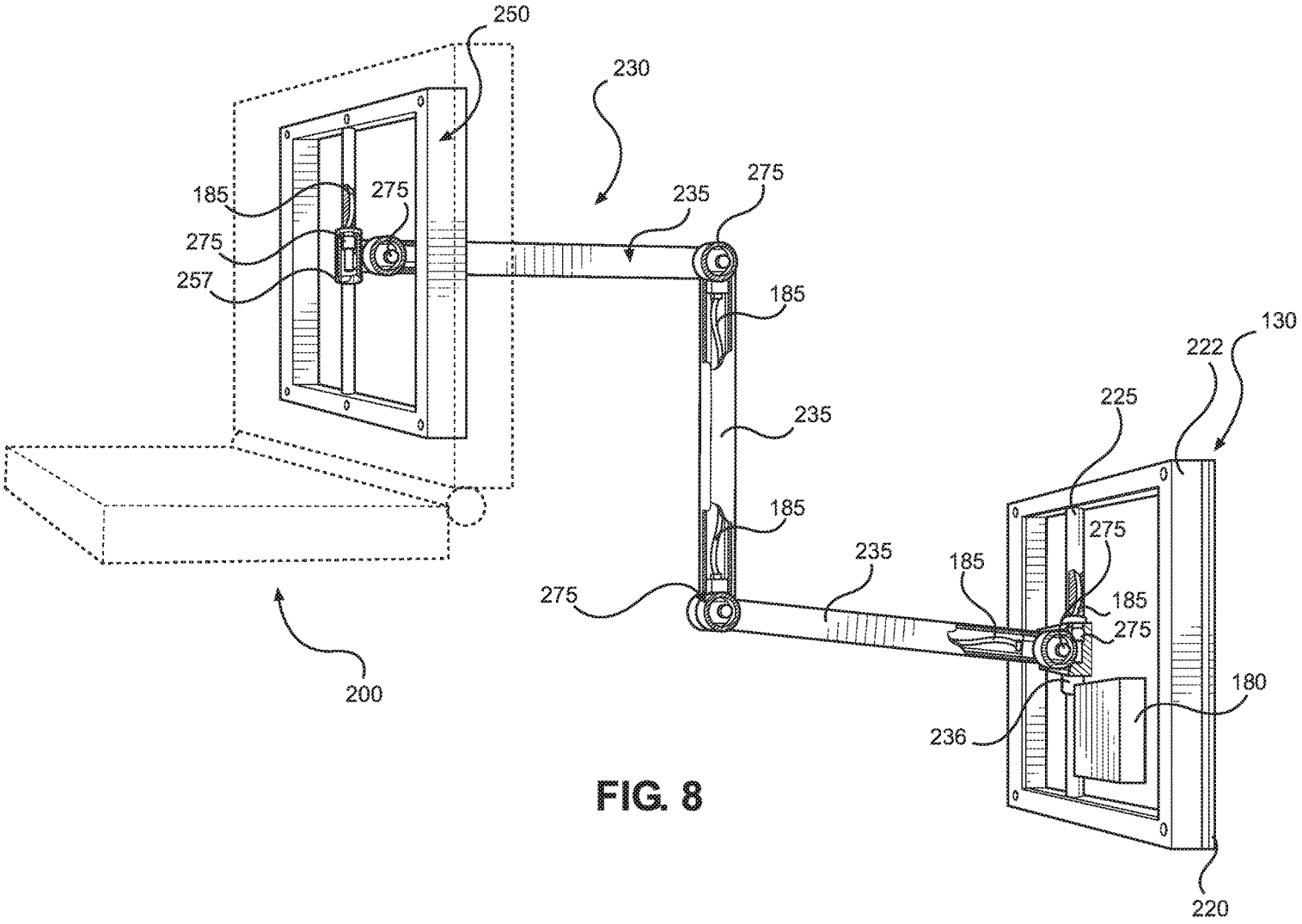
FIG. 8 shows a back perspective view illustrating the alternate embodiment of the adjustable bathing booster seat system of the present invention of FIG. 6.
Figure 9:
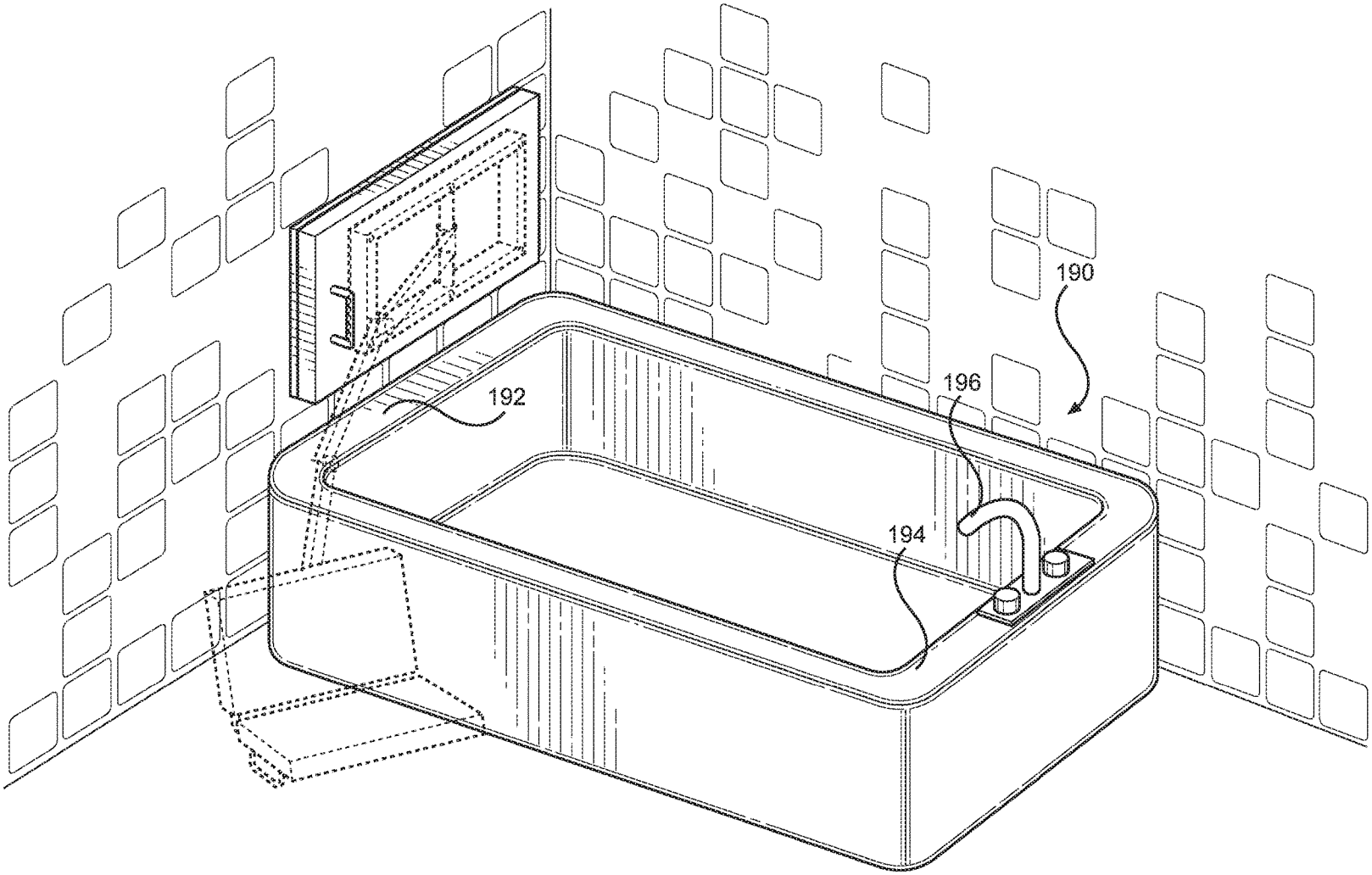
FIG. 9 shows a perspective view illustrating an adjustable bathing booster seat system of the alternate embodiment of the present invention of FIG. 6 installed within a wall and then (in dashed lines) extended outwardly adjacent the bathtub.

Referring now to FIG. 5, a flowchart illustrating a method of use 500 of adjustable bathing booster seat system 100 according to an embodiment of the present invention of FIGS. 1-4.

Method of use 500 for adjustable bathing booster seat system 100 preferably comprises the steps of: step one 501 sitting on seat portion 115 of booster seat assembly 110; step two 502 raising leg support section 126 of seat portion 115 to a horizontal position; step three 503 raising booster seat assembly 110 to a height able to clear side 194 of bathtub 190; step four 504 rotating booster seat assembly 110 to a position above bathtub 190; step five 505 lowering booster seat assembly 110 into bathtub 190; step six 506 bathing a user until completed; step seven 507 raising booster seat assembly 110 to a height above side 194 of bathtub 190; step eight 508 rotating booster seat assembly 110 to a position outside of bathtub 190; step nine 509 lowering leg support section 126 to form upright chair 145 configuration of booster seat assembly 110; step ten 510 lowering booster seat assembly 110 to level for user to exit booster seat assembly 110; and optionally step eleven 511 repeating steps as desired by a user.

FIGS. 6-9 illustrate an alternate embodiment of the present invention. This alternate embodiment consists of an adjustable bathing booster seat system comprising a booster seat assembly 200 having a seat portion 115 including a back rest 118 and a seat platform 120, wherein the seat platform is pivotably attached to the back rest, such that the back rest and the seat platform are adapted to fold upon one another; a wall mount assembly 130 comprising a wall mounting bracket 220, wherein the wall mounting bracket is adapted to be installed within a space within the wall adjacent the bathtub; an adjustable arm coupler 230, wherein the adjustable arm coupler is adjustably connected between the wall mounting bracket and the booster seat assembly, such that the booster seat assembly is adapted to be stored within the space within the wall adjacent the bathtub, pulled out from the space within the wall, extended outward therefrom, and be able to be manipulated by hand such that the user may sit on the seat portion outside of the bathtub and then be moved into and out of the bathtub, thereby assisting the user into and out from said bathtub.

The seat portion 115 may include at least one arm rest 122 attached thereto, such that the user can grab the arm rest to pull the booster seat assembly out from the space in the wall and manipulate it into a desired position, then use the arm rest to secure and hold themselves upon the seat portion while being moved into and out of the bathtub, then use the arm rest to manipulate and place and secure the booster seat assembly back into the space within the wall for storage.

The wall mount assembly 130 is adapted to be located within a wall located adjacent the bathtub and on an opposite side from the faucet 196 serving said bathtub. The wall mount assembly 130 can be formed from stainless steel hardware such that it does not corrode with use around water. The wall mounting bracket 220 is attached to the wall mount assembly, using means known in the art, and is formed as a rectangular frame 222 having a center bar 225 extending vertically from a bottom side of said frame to a top side of said frame, and is adapted to allow rotational movement of a distal end of the adjustable arm coupler 230.

The adjustable arm coupler 230 comprises at least two arm members 235 connected to one another in an end-to-end articulating fashion and are adapted to pivot and adjustably and securely connect to one another, a tubular shaped connector member 236 located on a distal end of one of the at least two arm members adapted to fit around the center bar of the rectangular frame of the wall mounting bracket and is adapted to rotate upon the center sliding bar in a horizontal plane to a floor surface that the bathtub resides upon; and a connector member 257 attached to a proximal end of the adjustable arm coupler and is adapted to pivotally connect to the back rest of the seat portion of the booster seat assembly, wherein the booster seat assembly is adapted to be moved in multiple degrees of freedom to the wall mounting bracket.

The booster seat assembly 200 further comprises a seat bracket member 250 attached to a back portion of said back rest of said seat portion, and is adapted to pivotally connect to said connector member 257 of said proximal end of said adjustable arm coupler.

In order to mechanically assist movement of the seat portion, the adjustable arm coupler 230 comprises a mechanical motor 275 mounted between the adjustable arm coupler distal end and said wall mounting bracket; a mechanical motor 275 mounted between each of the arm members, and a mechanical motor 275 mounted between the adjustable arm coupler proximal end and the seat portion; and wherein the mechanical motors 275 are adapted to move the arm members and thereby the adjustable arm coupler in relation to the wall mounting bracket and thereby move the seat portion in relation to the wall mounting bracket and the bathtub, to thereby mechanically assist a user into and out of said bathtub. Each mechanical motor 275 can be formed as a servo-motor, although other types of motors known in the art may be used, that is adapted to start and stop and move it in a direction chosen by the user when applying a force in the direction chosen.

An electric power source 180 is mounted within the space in the wall adjacent the wall mounting bracket, and electrical wires 185 are attached between the electric power source and each of the mechanical servo-motors thereby providing power to each of the mechanical servo motors.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. An adjustable bathing booster seat system comprising:
a booster seat assembly comprising:
a seat portion including:
a back rest; and
a seat platform;
wherein said seat platform is pivotably attached to said back rest, such that said back rest and
said seat platform are adapted to fold upon one another;
a wall mount assembly comprising;
a wall mounting bracket formed as a rectangular frame having a center bar extending vertically from a bottom side of said frame to a top side of said frame, the wall mounting bracket installed within a housing attached to a wall adjacent a bathtub;

an adjustable arm coupler comprising:

at least two arm members connected to one another in an end-to-end articulating fashion and are adapted to pivot and adjustably and securely connect to one another;

a tubular shaped connector member located on a distal end of one of said at least two arm members adapted to fit around said center bar of said rectangular frame of said wall mounting bracket and is adapted to rotate upon said center bar in a horizontal plane to a floor surface that said bathtub resides upon; and a connector member attached to a proximal end of said adjustable arm coupler and is adapted to pivotally connect to said back rest of said seat portion of said booster seat assembly;

wherein said booster seat assembly is adapted to move in multiple degrees of freedom with respect to said wall mounting bracket; and, wherein said adjustable arm coupler is adjustably connected between said wall mounting bracket and said booster seat assembly, such that said booster seat assembly is adapted to be stored within said housing adjacent said bathtub and using said adjustable arm coupler said booster seat assembly is pulled out from and extended outward from within said housing, and wherein said booster seat assembly is manipulated such that a user may sit on said seat portion outside of said bathtub and then be moved into and out of said bathtub, thereby assisting said user into and out from said bathtub.

2. The adjustable bathing booster seat system of claim 1, wherein said booster seat assembly further comprises a seat bracket member attached to a back portion of said back rest of said seat portion, and is adapted to pivotally connect to said connector member of said proximal end of said adjustable arm coupler.

3. The adjustable bathing booster seat system of claim 1, wherein said at least two arm members of said adjustable arm coupler comprises at least three arm members connected to one another in an end-to-end articulating fashion and are adapted to pivot and adjustably and securely connect to one another.

4. The adjustable bathing booster seat system of claim 3, further comprising a mechanical motor mounted between said adjustable arm coupler distal end and said wall mounting bracket;

a mechanical motor mounted between each of said at least three arm members, and a mechanical motor mounted between said adjustable arm coupler proximal end and said seat portion; and wherein said mechanical motors are adapted to move said at least three arm members and thereby said adjustable arm coupler in relation to said wall mounting bracket and thereby move said seat portion in relation to said wall mounting bracket and said bathtub, to thereby mechanically assist a user into and out of said bathtub.

5. The adjustable bathing booster seat system of claim 1, wherein said adjustable arm coupler comprises at least one mechanical motor mounted thereon and is adapted to move said adjustable arm coupler in relation to said wall mounting bracket and thereby move said seat portion in relation to said wall mounting bracket and said bathtub, to thereby mechanically assist a user into and out of said bathtub.

6. The adjustable bathing booster seat system of claim 1, further comprising a mechanical motor mounted between said adjustable arm coupler distal end and said wall mounting bracket;

a mechanical motor mounted between each of said at least two arm members, and a mechanical motor mounted between said adjustable arm coupler proximal end and said seat portion; and wherein said mechanical motors are adapted to move said at least two arm members and thereby said adjustable arm coupler in relation to said wall mounting bracket and thereby move said seat portion in relation to said wall mounting bracket and said bathtub, to thereby mechanically assist a user into and out of said bathtub.

7. The adjustable bathing booster seat system of claim 6, wherein each said mechanical motor is formed as a servomotor adapted to start and stop and move said at least two arm members in a direction chosen by said user.

8. The adjustable bathing booster seat system of claim 7, further comprising an electric power source adapted to be mounted within said housing and adjacent said wall mounting bracket; and electrical wires attached between said electric power source and each mechanical servo motor thereby providing power to each mechanical servo motor.

9. The adjustable bathing booster seat system of claim 1, wherein at least one arm rest is located on a bottom side of said seat portion, such that when folded and placed within said wall mount assembly said at least one arm rest is accessible by a user for grabbing and pulling said seat portion out of said wall mount assembly and into a desired position and for moving said seat portion back into said wall mount assembly when not in use.

10. The adjustable bathing booster seat system of claim 9, wherein said seat portion includes two arm rests attached thereto and spaced from one another.

11. The adjustable bathing booster seat system of claim 1, wherein said booster seat assembly is fabricated of durable recycled plastic material such that it does not corrode with use.

12. The adjustable bathing booster seat system of claim 11, wherein said durable recycled plastic material is covered with a nonslip rubber surface on said seat portion to protect said user from sliding about on said seat portion.

13. The adjustable bathing booster seat system of claim 1, wherein said wall mount assembly comprises carbon fiber and stainless steel hardware such that said wall mount assembly does not corrode with use.

14. The adjustable bathing booster seat system of claim 1, wherein said housing for said wall mount assembly is located adjacent said bathtub and on an opposite side from a faucet serving said bathtub.

15. The adjustable bathing booster seat system of claim 1, wherein said booster seat assembly is adapted to fit within the bathtub.

16. The adjustable bathing booster seat system of claim 1, wherein said wall mount assembly comprises stainless steel hardware such that said wall mount assembly does not corrode with use.

* * * * *